US008671711B2

(12) United States Patent
Kim

(10) Patent No.: US 8,671,711 B2
(45) Date of Patent: Mar. 18, 2014

(54) REFRIGERATOR AND ICEMAKER ASSEMBLY WITH PROVISIONS FOR GUIDING COOL AIR FLOW TO AN ICE TRAY

(75) Inventor: Jong Gon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1214 days.

(21) Appl. No.: 12/057,239

(22) Filed: Mar. 27, 2008

(65) Prior Publication Data

US 2008/0236187 A1 Oct. 2, 2008

(30) Foreign Application Priority Data

Mar. 28, 2007 (KR) ..... 10-2007-0030504

(51) Int. Cl.
*F25D 3/02* (2006.01)
*F25D 17/02* (2006.01)

(52) U.S. Cl.
USPC ..... 62/420; 62/425; 62/340; 62/377

(58) Field of Classification Search
USPC ..... 62/344, 356, 340, 420, 377
See application file for complete search history.

(56) References Cited

U.S. PATENT DOCUMENTS 4,618,415 A * 10/1986 Vecchio et al. ..... 209/134
2005/0241329 A1* 11/2005 Castrellon et al. ..... 62/340

FOREIGN PATENT DOCUMENTS

JP 06-011228 * 1/1994 ..... F25D 11/02
JP 2004-332981 A 11/2004
KR 10-2002-0014758 A 2/2002
KR 10-2005-0027671 A 3/2005
KR 10-2005-0077844 A 8/2005
KR 10-0661983 B1 12/2006

* cited by examiner

*Primary Examiner* — Cassey D Bauer
(74) *Attorney, Agent, or Firm* — Birch, Stewart, Kolasch & Birch, LLP

(57) ABSTRACT

An icemaker assembly and a refrigerator having the icemaker assembly are provided. The icemaker assembly includes a cover directing cool air toward an ice tray and a bracket for enhancing flow of the cool air directed toward the ice cover.

8 Claims, 7 Drawing Sheets

Related Art

Related Art

REFRIGERATOR AND ICEMAKER ASSEMBLY WITH PROVISIONS FOR GUIDING COOL AIR FLOW TO AN ICE TRAY

CROSS-REFERENCE TO RELATED APPLICATIONS

The present application claims priority under 35 U.S.C. 119 and 35 U.S.C. 365 to Korean Patent Application No. 10-2007-0030504(Mar. 28, 2007), which is hereby incorporated by reference in its entirety.

BACKGROUND

The present disclosure relates to a refrigerator and an icemaker assembly of the refrigerator.

Generally, a refrigerator is a home appliance that stores food at a low temperature. The refrigerator has a freezing compartment and a refrigerating compartment to store the food stuffs in accordance with kinds of the food stuffs.

Recently, a variety of refrigerators having an icemaker has been released so as to hit the right chord with consumers.

FIG. 1 is a perspective view of a refrigerator according to the related art, and FIG. 2 is a cross-sectional view of a refrigerator door icemaker according to the related art. Referring to FIGS. 1 and 2, a refrigerator main body 10 is formed in a rectangular parallelepiped shape. An inner chamber of the main body 10 is divided into a refrigerating compartment 12 and a freezing compartment 14.

A plurality of shelves and drawers are provided in the refrigerating and freezing compartments 12 and 14. Cool air is selectively directed to the refrigerating and freezing compartments 12 and 14 so that the refrigerating and freezing compartments 12 and 14 can realize different food storage environments.

In order to selectively direct the cool air to the refrigerating and freezing compartments 12 and 14, a partition 20 is disposed at a rear-half of the refrigerator main body 10 spaced apart from an inner surface of a rear wall of the refrigerator main body 10. A heat exchange chamber 22 is defined between the inner surface of the rear wall of the refrigerator main body 10 and the partition 20. That is, the partition extends from an inner-upper end of the refrigerator main body 10 to an inner-lower end of the refrigerator main body 10 to define the heat exchange chamber 22. A heat exchanger 24 for generating the cool air and a fan motor 26 for forcedly circulating the cool air are installed in the heat exchange chamber 22.

That is, the cool air is generated in the heat exchange chamber 22 by the operation of the heat exchanger 24 and the generated cool air 26 is directed into the refrigerator main body 10 by the fan motor 26. Meanwhile, the partition 20 is provided at an upper portion with an air outlet 28 through which the cool air is discharged into the refrigerator main body 10 and toward an icemaker 40.

The refrigerating and freezing compartments 12 and 14 have respectively opened front portions. Refrigerator doors 30 are respectively provided on the opened front portions of the refrigerating and freezing compartments 12 and 14.

A dispenser 32 is provided on a front portion of the refrigerator door 30. The dispenser 32 allows a user to get ice or purified water without opening the refrigerating door 30.

The icemaker 40 is provided inside one of the refrigerator doors 30. The icemaker is for making and storing the ice. The icemaker 40 is generally provided on an inner portion of the door 30 for the freezing compartment 14.

Needless to say, the icemaker 40 may be provided on the door 30 for the refrigerating compartment 12. The dispenser 32 may be provided on the door 30 in which the icemaker 40 is provided.

The icemaker 40 includes an ice making unit 50 that is mounted on a rear surface of the door 30 to make ice, an ice conveying unit 60 that is disposed under the ice making unit 50 to store the ice and convey the ice to the dispenser 32, and a case 70 enclosing the ice making unit 50 and the ice conveying unit 60.

The ice making unit 50 includes an ice tray 52 for storing water used for making the ice and a bracket 54 on which the ice tray 52 is mounted. At this point, shielding member 56 is formed on the bracket 54 to partly shield a top of the ice tray 52.

The shielding member 56 confines cool air introduced into the icemaker 40 and directed toward the ice tray 52 within a portion around the ice tray 52 so that the water in the ice tray 52 can be more quickly frozen. The shielding member 56 is rounded to define a dome shape. That is, the shielding member 56 extends from the bracket 56 supporting both sides of the ice tray 52 toward an approximately top center of the ice tray 52. Therefore, the shielding member 56 is disposed above both sides of the ice tray 52 except for a central top of the ice tray 52.

Meanwhile, the ice tray 52 is rotatably mounted on the brackets 54 so that the ice made in the ice tray 52 can fall down by the rotation of the ice tray 52.

The ice conveying unit 60 is disposed under the ice making unit 50 to store the ice from the ice tray 52 and conveying the stored ice to the dispenser 32. The ice conveying unit 60 includes an ice conveying member 62 formed in a spiral shape and a motor 64 that is connected to the ice conveying member 62 to rotate the ice conveying member 62.

The ice making unit 50 and the ice conveying unit 60 are enclosed by the case 70. The case 70 is mounted on a rear surface of the door 30 to define a portion of the rear surface of the door 30.

As described above, the case 70 is configured to receive both the ice making unit 50 and the ice conveying unit 60. The case 70 is provided with a cool air inlet 72 through which the cool air is introduced into the icemaker 70.

At this point, the cool air inlet 72 is formed on an upper portion of a rear surface of the case 70 so that the cool air discharged through the cool air outlet 28 formed on the partition 20 can be directly introduced.

In order to effectively receive the cool air introduced through the cool air inlet 72, the ice making unit 50 is mounted on the rear surface of the door 30

However, the icemaker of the related art has the following limitations.

The cool air is introduced into the icemaker 40 through the cool air inlet 72 opened rearward. However, since the ice tray 52 is designed to be opened upward by the shielding member 56, the cool air introduced into the icemaker 40 cannot be fully directed to the ice tray 52. Therefore, the cool air cannot be fully utilized in the icemaker 40.

Therefore, the ice making performance is deteriorated and thus the ice making efficiency is deteriorated.

In order to compensate for the above limitation, the dome-shaped shielding member 56 is formed on the bracket 54 to confine the cool air within a portion around the top of the ice tray 52.

However, when the cool air is continuously confined within the portion around the top of the ice tray 52, a frost may be formed on a surface of the shielding member and the frost may keep growing by the repeated ice making processes.

Therefore, an amount of the cool air introduced into the ice tray 52 is reduced due to the growing of the frost.

SUMMARY

In an embodiment, an icemaker assembly of a refrigerator includes an ice tray provided on a door of the refrigerator; a bracket on which the ice tray rotatably mounted and which has opened top to guide a flow of cool air; and a cover that shields an above portion of the bracket and is opened toward the opened top of the bracket to guide the cool air to a top surface of the ice tray.

In another embodiment, an icemaker assembly for a refrigerator includes a bracket mounted on a side of a door of the refrigerator; an ice tray rotatably supported in the bracket and storing water used for making ice; a cover that is provided above the bracket to shield an above portion of the bracket; a plurality of grill ribs that are formed on a top surface of the cover to guide cool air into the cover; and at least one guide rib extending from at least one of the grill ribs toward the ice tray.

In still another embodiment, an icemaker assembly for a refrigerator includes a case provided on a rear surface of the door and defining a space; an ice tray received in the case and storing water used for making ice; a bracket for mounting the ice tray on a side of the door; a front guide portion formed on a portion of a front half of the bracket and guiding cool air toward the ice tray; a rear guide portion formed on a portion of a rear half of the bracket, the rear guide portion extending upward at an outer side of ice tray for guiding cool air toward the ice tray; a cover shielding a top surface of the case and provided with a cool air inlet formed by a plurality of grill ribs; and at least one guide rib extending from at least one of the grill ribs toward the ice tray to guide the cool air.

In still yet another embodiment, a refrigerator includes a main body defining a storage chamber; a door for selectively opening and closing the main body; a case mounted on a rear surface of the door and provided at a top surface with a cool air inlet; and an ice tray provided in the case and storing water used for making ice; a bracket mounting the ice tray on the rear surface of the door and guiding the cool air toward a top surface of the ice tray.

It is to be understood that both the foregoing general description and the following detailed description of the present invention are exemplary and explanatory and are intended to provide further explanation of the invention as claimed.

DETAILED DESCRIPTION OF THE EMBODIMENTS

Figure 1:
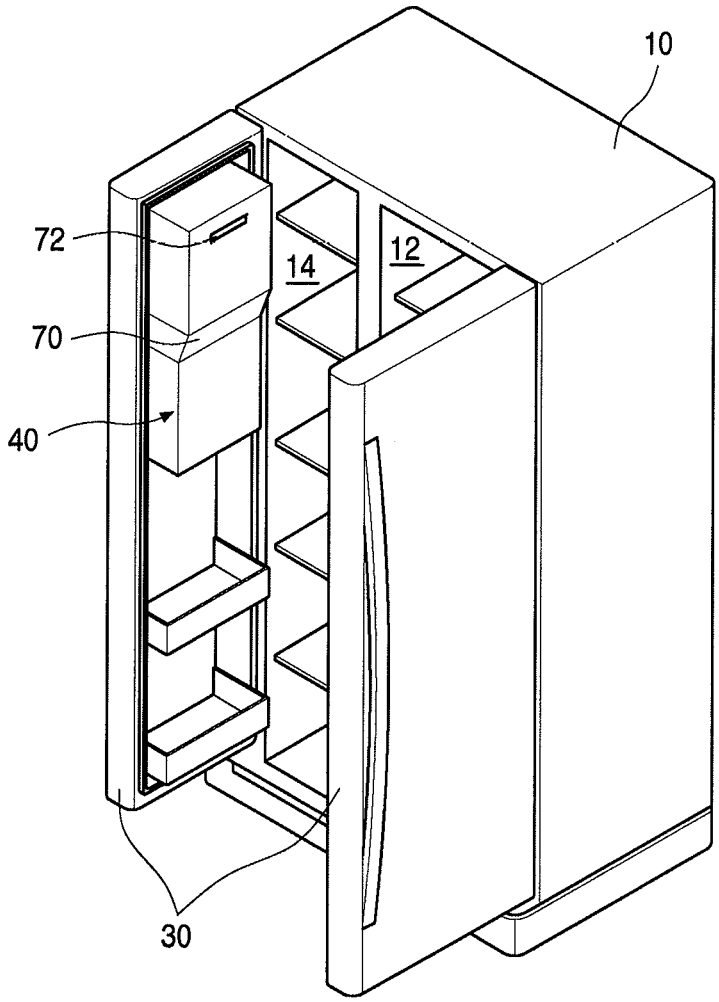
FIG. 1 is a perspective view of a refrigerator according to the related art.

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

Like reference numerals refer to like elements throughout the drawings including the drawings of the related art.

Figure 3:
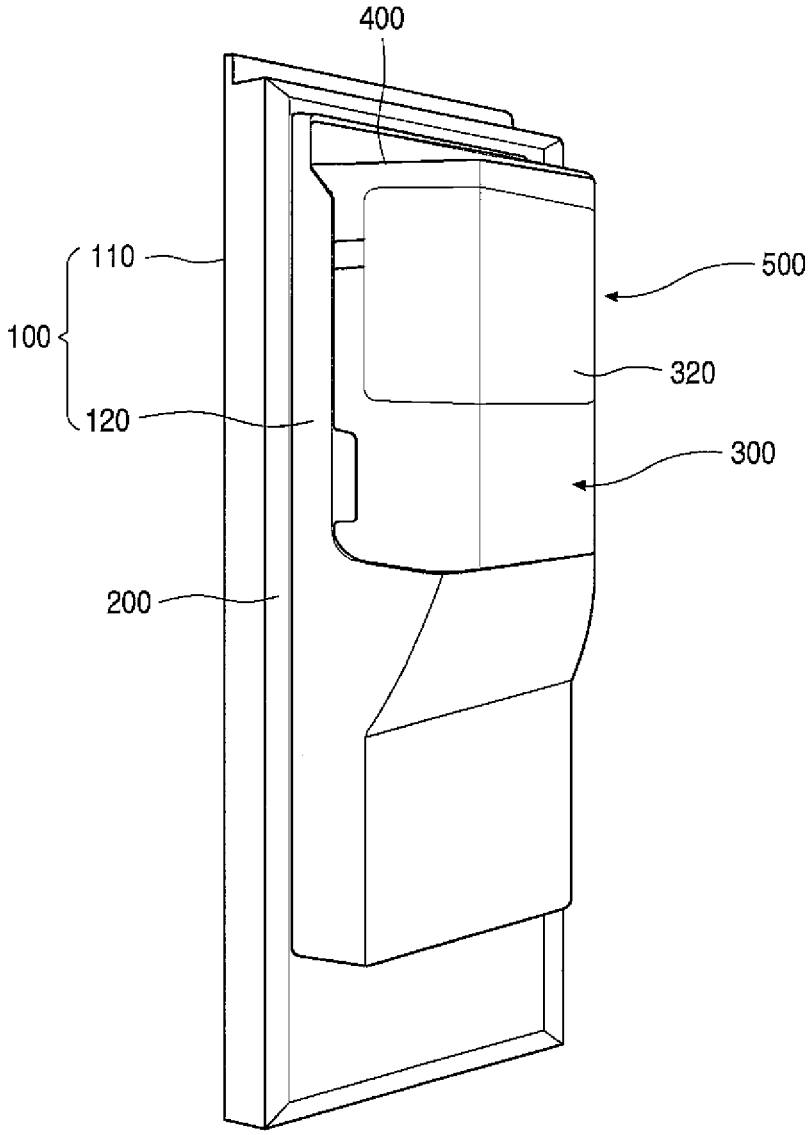
FIG. 3 is a partial perspective view of a rear structure of a refrigerator door employing an icemaker assembly according to an embodiment of the present invention.

FIG. 3 is a partial perspective view illustrating a rear structure of a refrigerating door having an icemaker assembly according to an embodiment of the present invention. A refrigerator door 100 shown in FIG. 3 is mounted on an opened front portion of a refrigerator main body (not shown) to open and close a refrigerating compartment (not shown) or a freezing compartment (not shown).

The refrigerating door 100 includes an outer case 110 defining a front portion and a side portion and a door liner 120 defining a rear portion. A gasket 200 is provided on a rear surface of the side portion of the refrigerator door 100 so that the refrigerator door 100 closely contacts the refrigerator main body.

The refrigerating door 100 may be a door for the freezing compartment. An icemaker assembly 500 for making and storing ice is provided on a rear surface of the door 100 for the freezing compartment. A dispenser (not shown) may be provided on a front portion of the door 100. The dispenser is connected to the icemaker assembly 500 to allow a user to take the ice without opening the door 100.

An exterior of the icemaker assembly 500 is defined by a case 300 and a cover 400. The case 300 is designed to enclose parts of the icemaker assembly 500 by being mounted on the door liner 120 of the door 100. That is, a space is defined by the case 300 mounted on the door liner 120 and parts of the icemaker assembly 500 are mounted in the space.

When the case 300 is mounted, the case 300 protrudes from the rear surface of the door 100. A transparent window 320 is formed on an upper portion of the case 300.

The user can observe an operation state of the icemaker assembly and an ice storage state through the transparent window 320. The transparent window 320 may be selectively opened through a pivotal motion to allow the user to perform a maintenance service and manipulate the parts in the case 300.

The case 300 has an opened top that is shielded by the cover 400. The cover 400 is designed to correspond to the opened top of the case 300. A top surface of the cover 400 is inclined downward as it goes rearward. That is, the top surface of the cover 400 is inclined downward as it goes toward the inside of the refrigerator main body so that the cool air can be effective supplied from the inside of the main body into the case 300. The cover 400 will be described in more detail below.

Figure 4:
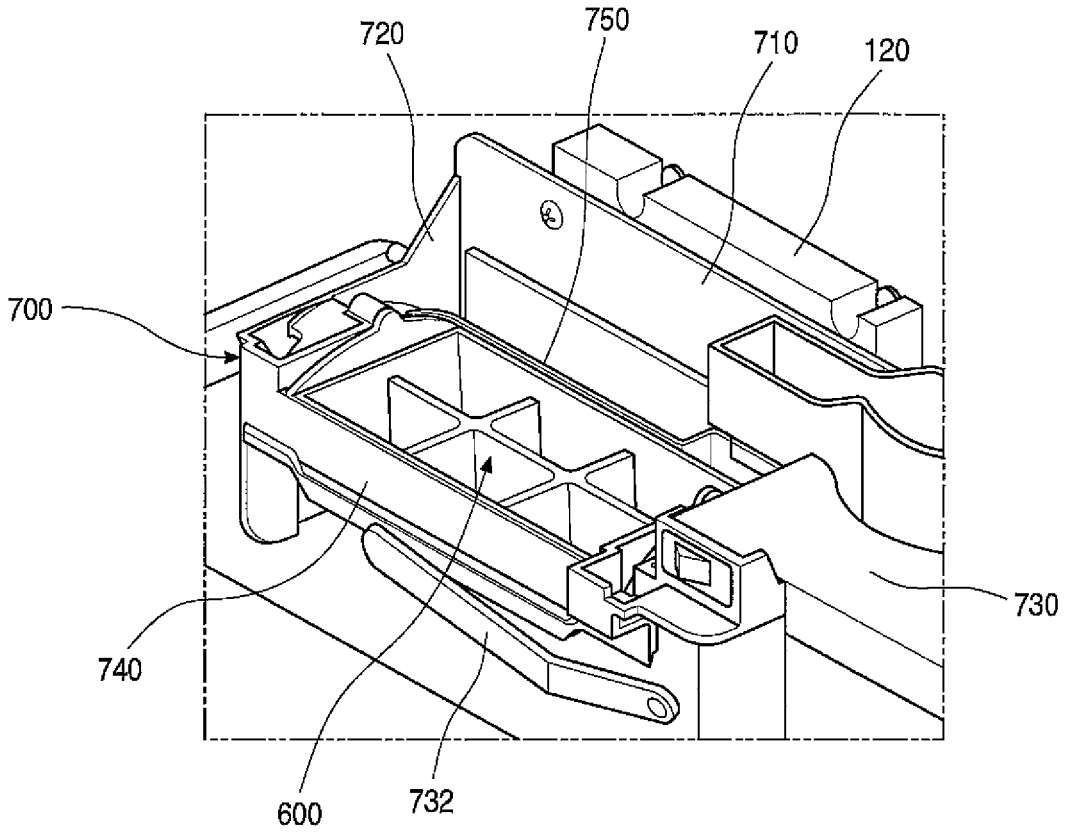
FIG. 4 is a partial perspective view of an icemaker assembly according to an embodiment of the present invention.
Figure 5:
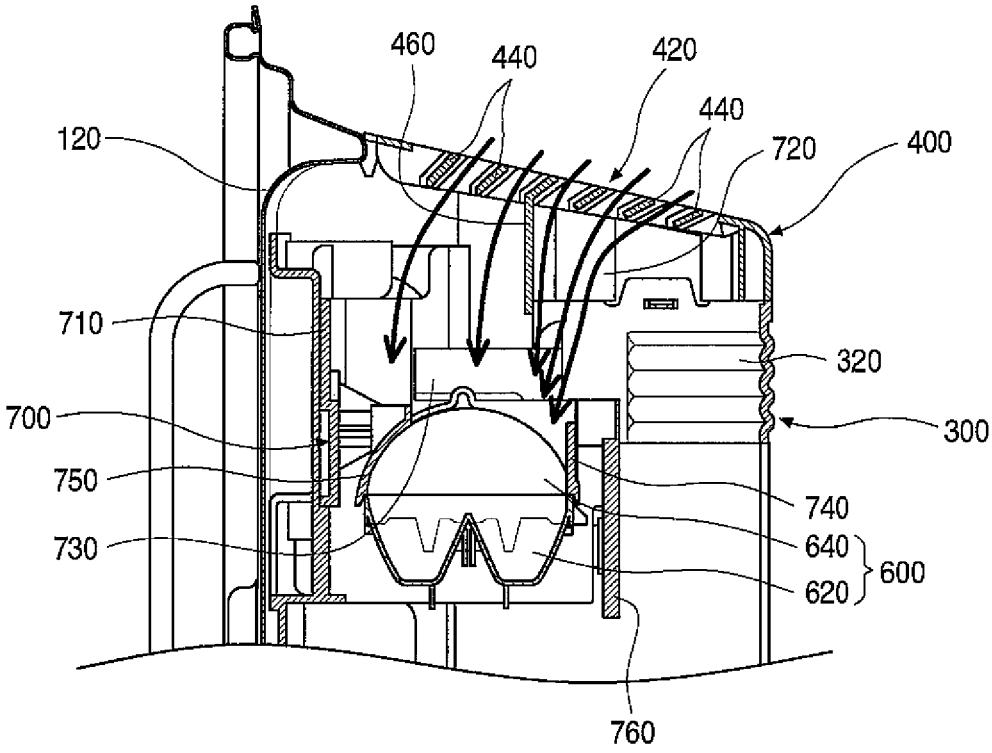
FIG. 5 is a cross-sectional view of the icemaker assembly of FIG. 4.

FIG. 4 is a partial perspective view of the icemaker assembly and FIG. 5 is a partial cross-sectional view of the icemaker assembly. The following will describe the icemaker assembly 500 with reference FIGS. 4 and 5.

The icemaker assembly 500 includes an ice tray 600 to which water is supplied and frozen, a bracket 700 for mounting the ice tray 600, and a driving mechanism for driving the ice tray 600. The ice tray 600 and the bracket 700 are enclosed by the cover 400 and the case 300.

The ice tray 600 stores the water used for the ice. The water stored in the ice tray 600 is frozen by cool air supplied from an outside of the icemaker assembly 500. The ice tray 600 has a predetermined width and a predetermined length. The ice tray 600 includes a water storing portion 620 and tray mounting portions 640 mounted on the bracket 700.

The water storing portion 620 is recessed downward to receive the water and divided into a plurality of sections. At this point, the plurality of sections may be arranged in two rows.

The tray mounting portions 640 are respectively formed on left and right side ends of the water storing portion 620 and axially coupled to the bracket to be capable of pivoting. The tray mounting portions 640 extend upward from the left and right side ends of the water storing portion 620 and are formed in a semicircular shape That is, an approximately central portion of each of the tray mounting portion 640 is axially coupled to the bracket 700 so that the tray can rotate about a longitudinal axis of the bracket 700. A stopper (not shown) is formed on a side of the ice tray 600 so as to restrict the rotation of the ice tray 600 by interfering with a side of the bracket 700 when the ice tray 600 rotates by about 180°.

The bracket 700 supports rotatably the ice tray 600 such that the ice tray 600 can be mounted on the rear surface, i.e., on the door liner 120 of the refrigerator door 100.

Figure 6:
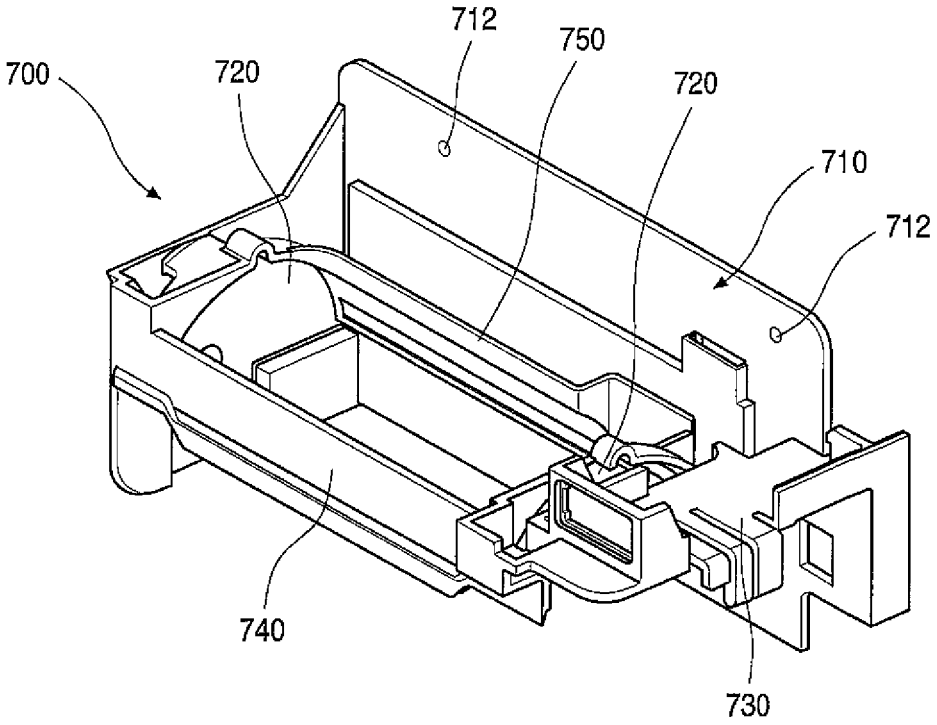
FIG. 6 is a perspective view of a bracket of the icemaker assembly of FIG. 4.

The following will describe the bracket 700 in more detail with reference to FIG. 6. FIG. 6 is a perspective view of the bracket. The bracket 700 includes a fixing portion 710, mounting portions 720, a front guide portion 750, and a rear guide portion 740.

The fixing portion 710 defines a front portion of the bracket 700 and is formed in a plate shape having a predetermined area such that the bracket 700 closely contacts the door liner 120. Screw holes 712 are formed on both sides of an upper portion of the fixing portion 710. Screws are coupled to the door liner 120 through the screw holes 712.

The mounting portions 720 are formed to perpendicularly extend from the both sides of the fixing portion 710. An extending length of the mounting portion 720 is greater than a width of the ice tray 600. Therefore, the ice tray 600 can be received between the mounting portions 720 extending from the both sides of the fixing plate 710. Holes or protrusions to which the ice tray axially coupled are formed on respective centers of the mounting portions 720.

A pivotal portion 730 is formed on an outer side of the right mounting portion 720 (in FIG. 6) of the bracket 700. The pivotal portion 730 defines a space in which the driving mechanism for rotating the ice tray 60 is mounted. The pivotal portion 730 extends outward from the mounting portion 720. The driving mechanism may include a plurality of gear assemblies that rotate the ice tray 600 in accordance with the manipulation of the operation lever 732. Alternatively, the driving mechanism may include an electric motor for automatically rotating the ice tray 600.

The rear and front guide portions 740 and 750 are formed between the left and right mounting portions 720 to connect rear and front halves of the left mounting portion 720 to rear and front halves of the left mounting portion, respectively. The rear and front guide portions 740 and 750 serve to prevent the water in the ice tray 600 from overflowing and to guide the cool air to the ice tray 600.

In more detail, the rear guide portion 740 is formed in rear of the ice tray 600 to connect the rear halves of the left and right mounting portions 720 to each other, thereby partly shielding the ice tray 600.

The rear guide portion 740 extends from an upper portion of the ice tray 600 upward. The rear guide portion 740 extends up to a level higher than a top surface of the water storing portion 620 of the ice tray 600.

The rear guide portion 740 extends vertically with respect to the top surface of the ice tray 600 to allow the cool air supplied toward the top surface of the ice tray 600 to pass along the top surface of the ice tray 600. That is, the rear guide portion 740 allows the cool air to effectively flow along the top surface of the ice tray 600.

A shielding portion 760 defining a rear portion of the bracket 700 is formed in rear of the rear guide portion 740. The shielding portion 760 interconnects rear ends of the left and right mounting portions 720. The shielding portion 760 has a predetermined height to shield the ice tray 600.

The rear guide portion 740 is spaced apart from the shielding portion 760. A vertical length of the shielding portion 760 is less than that of the fixing portion 710 so that the cool air effectively flows at a location near the ice tray 600.

Alternatively, the shielding portion 760 may be omitted from the bracket 700. Instead, the rear guide portion 740 interconnects the rear ends of the left and right mounting portions 720 to define the rear portion of the bracket 700.

The front guide portion 750 interconnects the front halves of the left and right mounting portions 720. The front guide portion 750 is spaced apart from the fixing portion 710 by a predetermined distance. The front guide portion 750 is rounded from a front top of the water storing portion 620 above a rear top. At this point, the front guide portion 750 has the same curvature as the tray mounting portion 640 of the ice tray 600.

The front guide portion 750 extends from a portion in front of the ice tray 60 to a portion above an approximately central portion of the top of the ice tray 600 to define a space above the top of the ice tray 600.

Therefore, the ice tray 600 can stably pivot by the front guide portion 750 and the cool air supplied to the top of the ice tray is not directed rearward from the bracket 700.

A front portion of the ice tray 600 is shielded by the front guide portion 750. The space above the top of the ice tray 600 is also partly shield by the front guide portion 750. Accordingly, the cool air supplied toward the ice tray 600 can fully flows along the top of the ice tray 600.

The cool air is directed into the icemaker assembly 50 (i.e., in the case 300) through the cover 400. The cool air flows from an upper portion to a lower portion of the inside of the case 300 to pass through a space defined between the front and rear guide portions 750 and 740 and subsequently through the ice tray 600.

At this point, in order to allow the cool air to effectively flow toward the ice tray 600, the space defined between the front and rear guide portions 750 and 740 may be aligned with an opening of the cover 400.

The following will describe the cover 500 in more detail with reference to FIG. 5.

The cover 400 is sized to shield the opened top defined by the case 300 coupled to the door liner 120. The top surface of the cover 400 is inclined downward as it goes rearward.

The cover 400 is provided at the top with a grill portion 420 through which the cool air is introduced. The grill portion is divided into a plurality of openings by a plurality of grill ribs 440 spaced apart from each other by a uniform interval. The grill portion 420 is formed to occupy most of the area of the top surface of the cover 400. The cool air is introduced into the case 300 through the openings of the grill portion.

Each of the grill ribs 440 has a predetermined width and a predetermined length corresponding to a left-right length of the cover 400. The grill ribs 440 are inclined so that the cool air effectively flows.

When considering a property of the cool air supplied from a rear side (a right side in FIG. 5), the cover 400 is designed to be inclined and the grill ribs 440 are formed to be inclined from the right-upper side to the left-lower side. In this case, the cool air supplied from the rear side can be effectively introduced into the cover 400, i.e., into the case 300.

At this point, when the grill ribs 440 are formed in parallel with the top surface of the cover 400, the cool air cannot be effectively introduced. When the grill ribs 440 are formed to be perpendicular to the top surface, the cool air cannot be also effectively introduced.

The grill ribs 440 may have the same inclination. However, in order to more effectively introduce the cool air, the grill ribs 440 may have different inclinations.

For example, the inclination of the grill ribs with respective to the top surface of the cover 400 can be gradually reduced as they go from a rear portion to a front portion.

At least one guide rib 460 may be formed on a lower end of the grill rib 440 to guide the cool air to the top surface of the ice tray 600. The guide rib 460 is bent at the lower end of the grill rib 440.

The guide rib 460 extends from the lower end of the grill rib 440 by a predetermined length and corresponds to the length of the grill rib 440 so that the cool air guided by the grill rib 440 can be directed toward the ice tray 600.

That is, the guide rib 460 vertically extends downward from the lower end of the grill rib 440 to allow the cool air introduced through the openings of the grill to be directed to the ice tray 600 along a surface of the guide rib 460.

The guide rib 460 may extend from the lower end of one of the grill ribs 440 such that it is aligned with a portion between the front and rear guide portions 750 and 740. At this point, the guide rib 460 is formed to be perpendicular to the top surface of the ice tray 600 so that the cool air guided by the grill ribs 440 can be directed to the top surface of the ice gray along the guide rib 460.

Accordingly, the cool air, which is introduced into the case 300 after being guided by the grill ribs 440 located in rear of the grill rib 440 from which the guide rib 460 extends, flows in the inclined direction of the grill ribs 440 and collides with the guide rib 460. Subsequently, the cool air passes through the space defined between the front and rear guide portions 750 and 740 along the guide rib 460 and is directed to the ice tray 600.

The guide ribs 460 may be formed to extend from a plurality of grill ribs 440 and inclined toward the top surface of the ice tray 600. That is, the guide ribs 460 may be variously modified.

Figure 7:
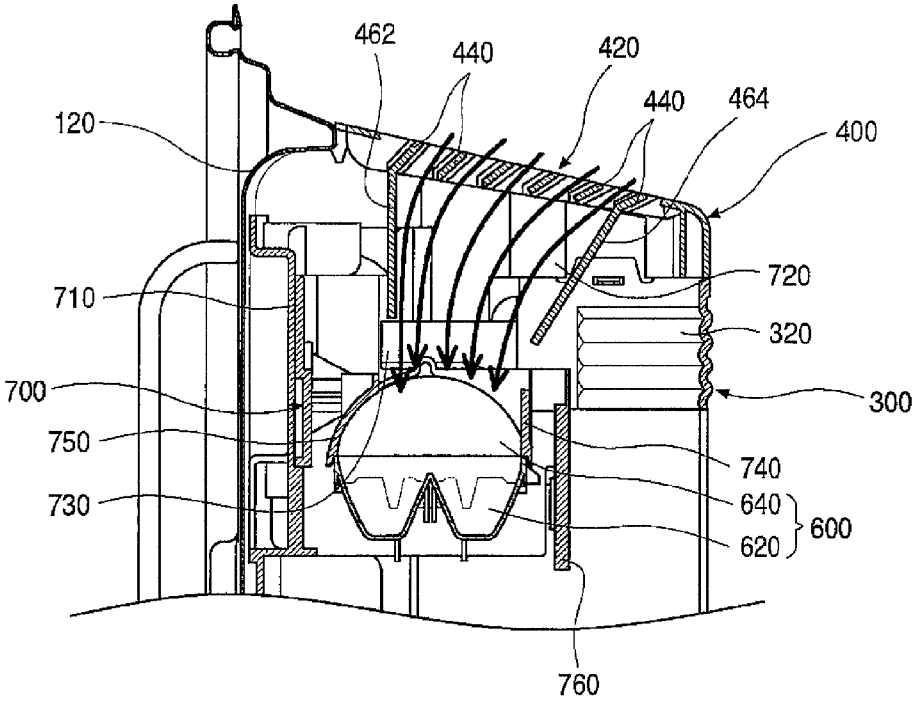
FIG. 7 is a cross-sectional view of an icemaker according to another embodiment of the present invention.

FIG. 7 is a cross-sectional view of an icemaker assembly according to another embodiment of the present invention.

Referring to FIG. 7, a first guide rib 462 extends downward from a lower end of one of the grill ribs 44, which is closest to the door liner 120, and a second guide rib 464 extends downward from another one of the grill ribs 44, which is farthest from the door liner 120.

The first guide rib 462 extends toward the front guide portion 750 of the bracket 700 and the second guide rib 464 extends toward the rear guide portion 740. Therefore, cool air guided by the grill ribs 440 is directed to the top surface of the ice tray 600 by being guided by the first and second guide ribs 462 and 464.

The following will describe operation of the above-described icemaker assembly.

Figure 2:
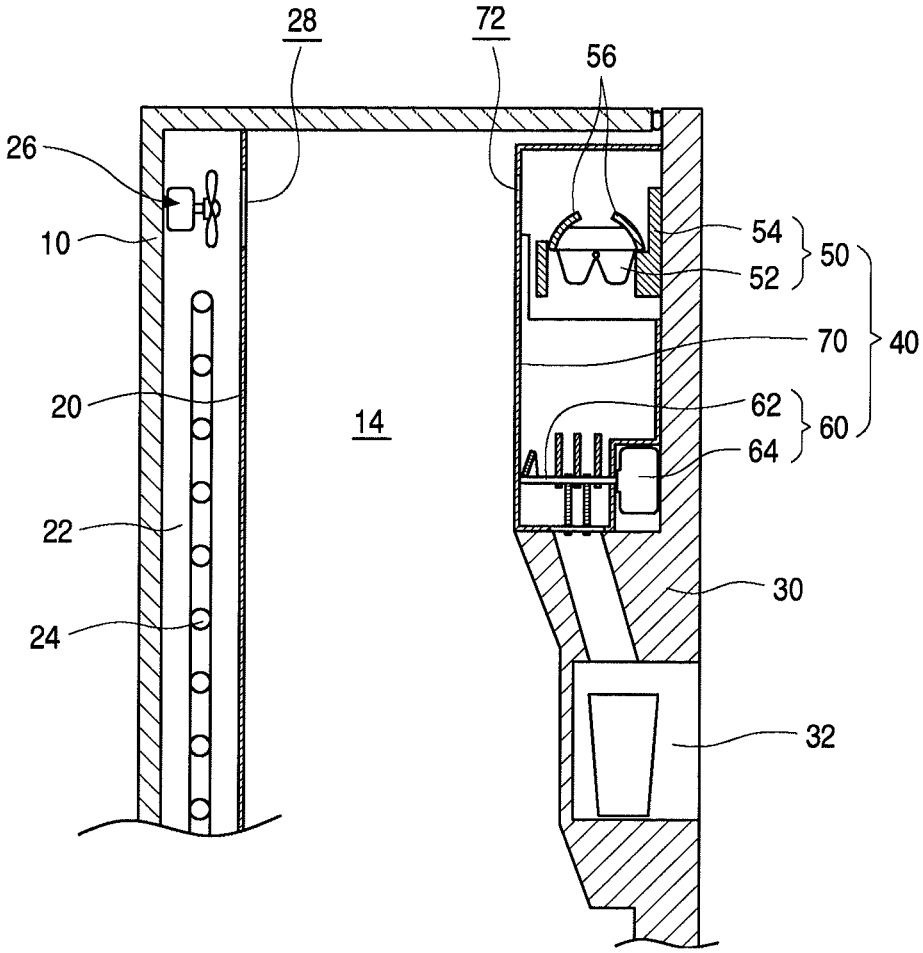
FIG. 2 is a cross-sectional view of an icemaker according to the related art.

When electric power is applied to the refrigerator, the heat exchanger 24 generates cool air. The cool air generated by the heat exchanger 24 is supplied to the inside of the refrigerator 10 main body through the cool air outlet 28 by the fan motor 26 (see FIGS. 1 and 2).

The air supplied through the cool air outlet 28 is forcedly directed to the rear surface of the door 100 and introduced into the icemaker assembly 500 through the cover 400.

Alternatively, the cool air generated by the heat exchanger 24 may be supplied through a separate duct. In this case, the duct is formed to extend from a portion near the heat exchanger 24 to a portion near the cover 400 along a top inner wall of the freezing compartment.

The cool air forcedly supplied toward the cover 400 is guided into the case 300 through the openings between the grill ribs 440 of the grill portion 420.

At this point, the cool air flows along the inclination of the grill ribs 440 and thus the cool air can be effectively introduced into the icemaker. As the inclinations of the grill ribs 444 are gradually reduced as they go rearward, the flow rate of the cool air introduced into the icemaker is gradually reduced as it goes from a front side to a rear side of the grill portion 420.

The cool air passing through the front openings between the front grill ribs 440 having relatively large inclinations is directed toward the ice tray 600 and the cool air passing through the rear openings between the rear grill ribs 440 having relatively small inclinations collides with the cool air passing through the front openings to be directed toward the ice tray 600.

The cool air introduced along the grill ribs 440 is guided by at least one guide rib 460 to the top surface of the ice tray 600 after passing through the space defined between the front and rear guide portions 750 and 740.

At this point, the guide rib 460 extends up to a portion near the space defined between the front and rear guide portions 750 and 740 to allow the cool air introduced from the grill ribs 440 in front of the guide rib 460 to be fully directed toward the ice tray 600. Therefore, the cool air introduced through the grill portion 420 can be fully directed toward the top surface of the ice tray 600.

The cool air directed to the top surface of the ice tray 600 heat-exchanges with the water stored in the ice tray 600 and thus the water is frozen. The cool air flows downward through an outer side of the ice tray 600.

At this point, since the rear guide portion 750 is formed in rear of the ice tray 600, a cool air passage directing the cool air flowing downward in the case 300 toward the top surface of and around the ice tray 600 is formed. Therefore, the cool air can effectively flow from an upper side to a lower side.

The ice making process is effectively realized by the cool air that is continuously fed to the ice tray 600. When the ice making process is completed, the ice tray 600 is twisted about the left and right mounting portions 720 to discharge the ice from the ice tray 600.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An ice maker assembly with provisions for guiding cool air flow to an ice tray, the ice maker assembly comprising:

a case mounted on a rear surface of a door and defining a space;

an ice tray received in the case and storing water used for making ice;

a cover disposed above the ice tray and covering an opened top surface of the case;

a plurality of grille ribs that are formed on a top surface of the cover to guide cool air into the cover;

at least one guide rib extending from at least one of the grille ribs toward the ice tray;

a bracket for mounting the ice tray inside of the case;

a front guide portion formed on a portion of a front half of the bracket, the front guide portion rounded from a portion in front of the ice tray to define a space above the top of the ice tray; and a rear guide portion formed on a portion of a rear half of the bracket, the rear guide portion extending upward at an outer side of ice tray for guiding cool air toward the ice tray, wherein the at least one guide rib is extended toward the space defined between the front and rear guide portions.

2. The ice maker assembly with provisions for guiding cool air flow to an ice tray according to claim 1, wherein a top surface of the cover is inclined downward toward a storage chamber of a refrigerator.

3. The ice maker assembly with provisions for guiding cool air flow to an ice tray according to claim 1, wherein the grille ribs make a predetermined angle with respect to the top surface of the cover.

4. The ice maker assembly with provisions for guiding cool air flow to an ice tray according to claim 3, wherein inclinations of the grille ribs are gradually increased rearward.

5. The ice maker assembly with provisions for guiding cool air flow to an ice tray according to claim 1, wherein the at least one guide rib is bent toward the top surface of the ice tray at a lower end of the grille rib.

6. The ice maker assembly with provisions for guiding cool air flow to an ice tray according to claim 1, wherein the at least one guide rib extends in a direction intersecting the top surface of the ice tray.

7. The ice maker assembly with provisions for guiding cool air flow to an ice tray according to claim 1, wherein the at least one guide rib includes a first guide rib extending from one of the grille ribs, which is closest to an inner surface of the door, and a second guide rib extending from another one of the grille ribs, which is farthest from the inner surface of the door.

8. The ice maker assembly with provisions for guiding cool air flow to an ice tray according to claim 7, wherein the first and second guide ribs are formed on two of the grille ribs, and the first and second guide ribs extend toward the front and rear guide portions, respectively.

* * * * *